United States Patent [19]

Garmon

[11] 4,172,550

[45] Oct. 30, 1979

[54] SIX CELL BOX AND BLANK THEREFOR

[75] Inventor: Ivan E. Garmon, St. Joseph, Mo.

[73] Assignee: Champion International Corporation, Stamford, Conn.

[21] Appl. No.: 947,648

[22] Filed: Oct. 2, 1978

[51] Int. Cl.[2] ..... B65D 5/48
[52] U.S. Cl. ..... 229/28 R
[58] Field of Search ..... 229/28 R

[56] References Cited

U.S. PATENT DOCUMENTS

| | | | |
|---|---|---|---|
| 2,880,921 | 4/1959 | Persson | 229/28 R |
| 2,909,311 | 10/1959 | Levitt | 229/28 R |
| 3,963,168 | 6/1976 | Frum | 229/28 R |

*Primary Examiner*—Davis T. Moorhead
*Attorney, Agent, or Firm*—Evelyn M. Sommer

[57] ABSTRACT

A single, planar paperboard blank is disclosed, which when folded, forms a rectangular box construction provided with integral divider partitions within the interior of the box. The partitions in conjunction with the side walls of the box define six individual cells or compartments for receiving articles.

14 Claims, 8 Drawing Figures

Fig. 4.
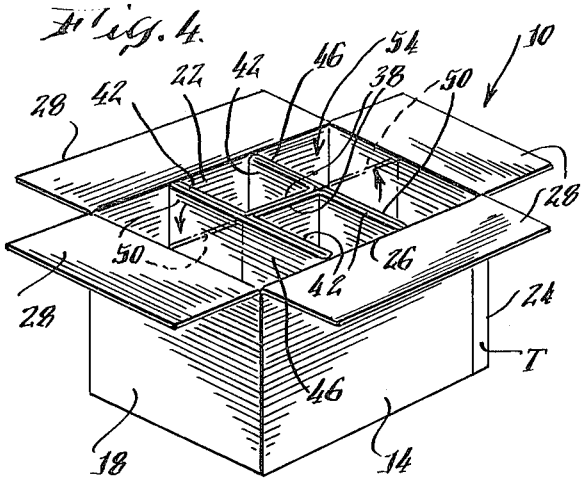
Fig. 5.
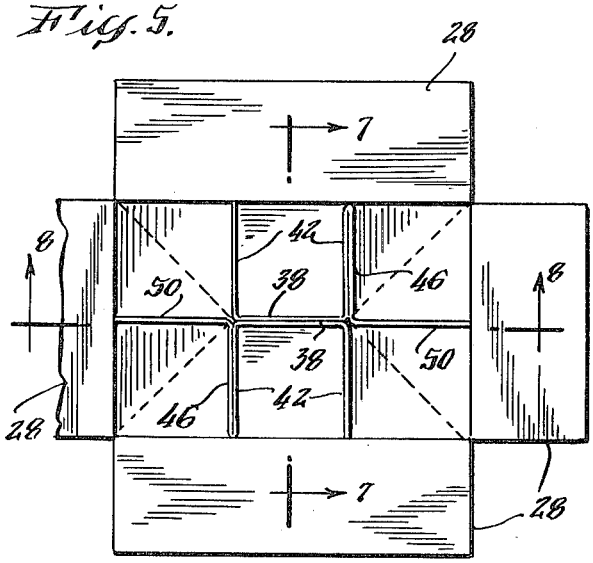
Fig. 6.
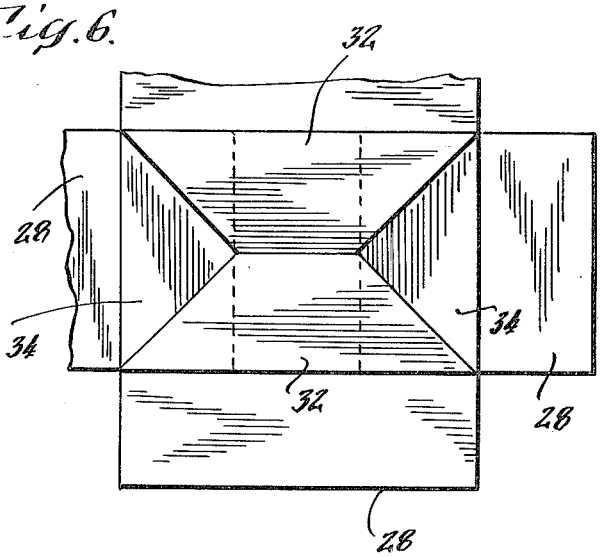
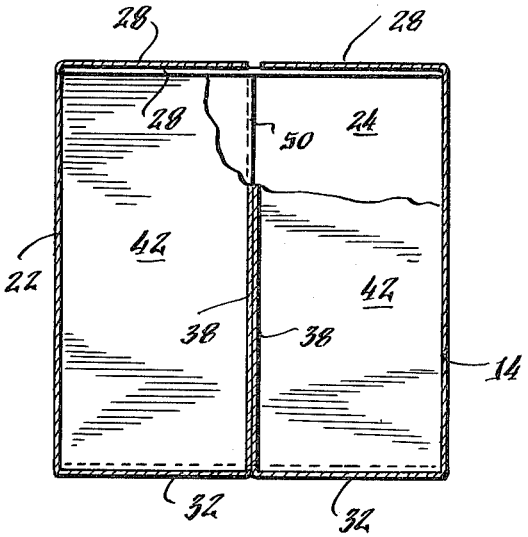
Fig. 7.
Fig. 8.
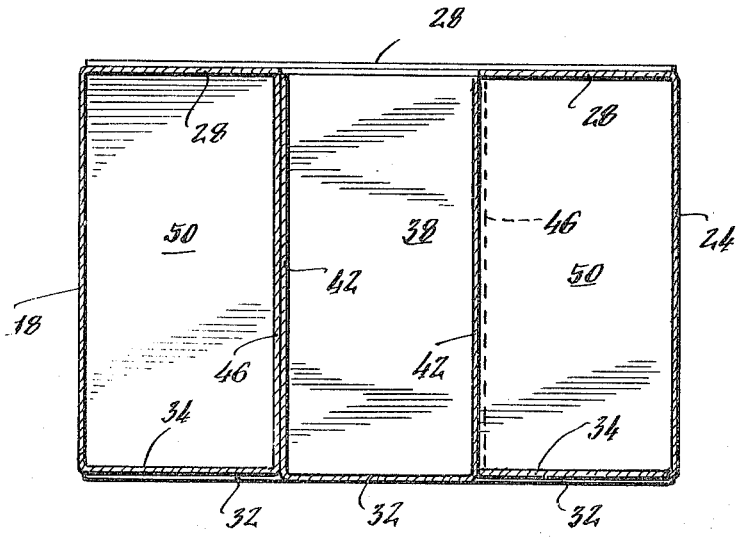

SIX CELL BOX AND BLANK THEREFOR

BACKGROUND OF THE INVENTION

1. Field of the Invention

This invention relates to a paperboard box construction, and more particularly, a paperboard box construction provided with integral divider panels for dividing the interior of the box into six equal cells.

2. Description of Prior Art

Corrugated paperboard boxes are used to hold a variety of articles. Where the articles include jars, bottles, cans or other cylindrical-type objects, the box interior is usually divided into a number of cells. Each cell holds one of the articles and is separated from an adjacent cell by a corrugated divider panel to minimize damage to the article occasioned by its contact with an adjacent article. This is of particular importance where the articles are made from glass, such as bottles or jars.

It was common practice, heretofore, to provide a separate, collapsible, multi-cell divider inserted within the box prior to insertion of the articles. The box is fully erected and the multi-cell collapsible divider for forming individual cells within the box is then inserted within the interior of the box. The multi-cell divider is formed from perpendicular, interleaved, and pivotal panels. The length of each panel within the interior of the box is equal to the width or length of the box, depending upon its orientation.

While the prior art construction precludes adjacent articles from intermingling and contacting each other, the provision of a separate multi-cell divider and separate box requires additional storage space and erection time for the combined box construction. Two separate operations are required to erect the box for use. The box must be folded and then the dividers inserted in the box. The parts are shipped separately to the user and would have to be stored separately until used.

Furthermore, the wall panels of the prior art multi-cell divider are single ply, resulting a low stacking strength of boxes provided with such dividers.

SUMMARY OF THE INVENTION

In accordance with the present invention, a multi-cell divider is formed integral with a planar die cut blank used to produce a corrugated box construction. The blank can be shipped to the user who could erect it on site into a multi-compartmented box, in one simple operation. On site storage is also more compact.

The multi-cell divider includes alternating three and two rectangular panel sections pivotably connected to the bottom closure panels of the box. The bottom closure panels are alternatively trapezoidal and rectangular in shape and are hingedly connected to the bottom edge of the side wall panels of the box. The rectangular panels in each rectangular panel section are hingedly connected to each other along a vertical score line. Each three panel section is hingedly connected to an adjacent two panel section, and the middle panel of the three panel section is pivotably connected to one of the trapezoidal bottom flaps. The rectangular panel of the two panel section pivotably connected to the three panel section is also pivotably connected to the bottom edge of an adjacent rectangular bottom panel. Rectangular top or closure flaps are connected by fold lines to the top edges of each side wall panel.

The box is erected by folding the side wall panels 90° relative to the bottom panels, while pivoting the rectangular panels in each two and three panel section in a like manner 90° relative to the bottom panels, until the rectangular panel sections and side wall panels are parallel. The individual panels in each two and three rectangular panel section are then folded 90° relative to each other about the vertical score lines. The side wall panels are also folded 90° relative to each other, resulting in a rectangular parallelopiped box provided with divider walls, formed by the individual rectangular panels in each two and three panel section connected to the bottom panels. The divider walls form six cells within the interior of the box.

At least some of the divider walls formed from the rectangular panels in each two and three section panel are disposed back-to-back to provide double or reinforced walls enabling the box to be readily stacked without collapsing.

BRIEF DESCRIPTION OF THE DRAWINGS

Further objects and advantages of the invention will become apparent from the following description and claims, and from the accompanying drawings wherein:

FIGS. 2 to 4, inclusive, are perspective views illustrating the manner of folding the blank of FIG. 1 to form the box of the present invention;

FIG. 5 is a top plan view of the erected box of FIG. 4;

FIG. 6 is a bottom plan view of the box of FIG. 4;

FIG. 7 is a cross-sectional view taken substantially along the plane indicated by line 7—7 of FIG. 5; and FIG. 8 is a cross-sectional view taken substantially along the plane indicated by line 8—8 of FIG. 5.

DETAILED DESCRIPTION OF THE PREFERRED EMBODIMENT

Figure 1:
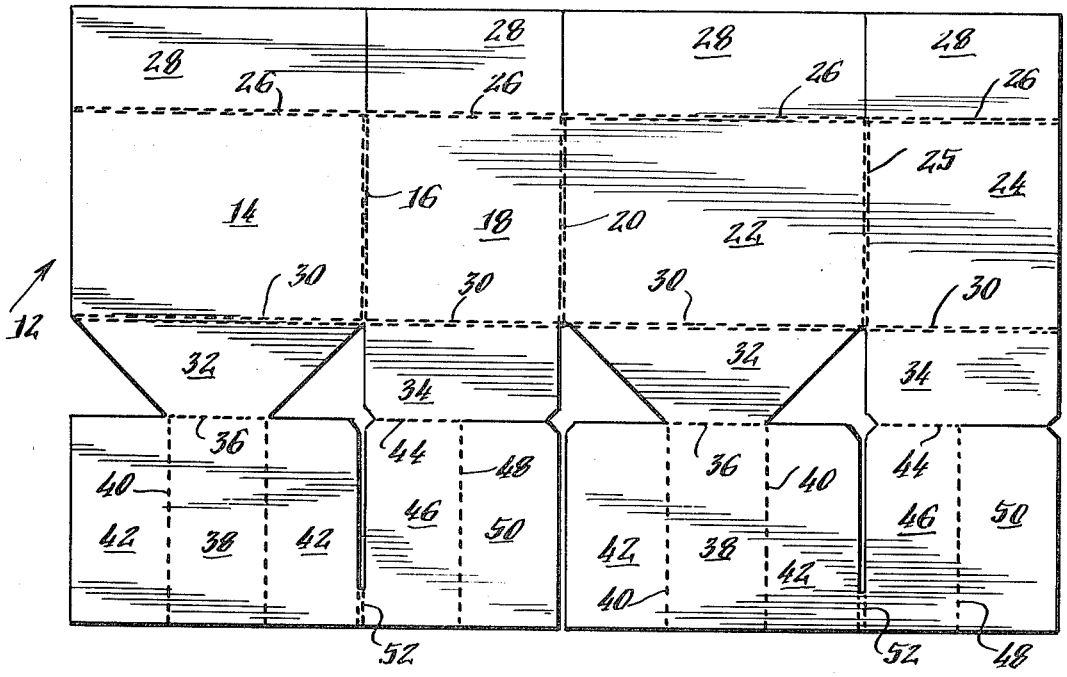
FIG. 1 is a plan view of a paperboard blank used to form the box of the present invention.

Referring now to the drawing in detail, wherein like numerals indicate like elements throughout the several views, the six cell box 10 of the present invention is formed from a planar blank 12 illustrated in FIG. 1.

The blank 12 includes a front rectangular side wall panel 14, connected by a double score line 16 to a side, rectangular side wall panel 18, which in turn is connected by a double, vertical score line 20 to a rear, side wall panel 22. Panel 22 is connected to a second side, rectangular wall panel 24 by a double vertical score line 25.

Connected by horizontal fold lines 26 to the top edges of panels 14, 18, 22 and 24 are top flaps 28.

Connected by a double fold line 30 to the bottom edge of both front and rear panels 14 and 22 is a trapezoidal shaped bottom panel 32. Connected by double fold line 30 to the bottom edge of side panels 18 and 24 is a rectangular bottom panel 34.

Pivotably connected by horizontal fold line 36 to the horizontal free edge of each trapezoidal panel 32 is a rectangular panel 38. Connected by a vertical fold line 40 to each side edge of panel 38 is a side rectangular panel 42 having the identical dimensions as the panel 38, forming a three rectangular panel section 42, 38, 42.

Pivotably connected by a horizontal score line 44 to one half of the bottom edge of each rectangular panel 34 is a rectangular panel 46. Connected to the right hand edge of each panel 46 by a vertical score line 48 is a rectangular panel 50. The panels 46 and 50 form a two rectangular panel section. Each of the rectangular panels 46 is connected by a double vertical fold line 52 to the right hand panel 42 of the adjacent three rectangular panel section 42, 38, 42.

Figure 2:
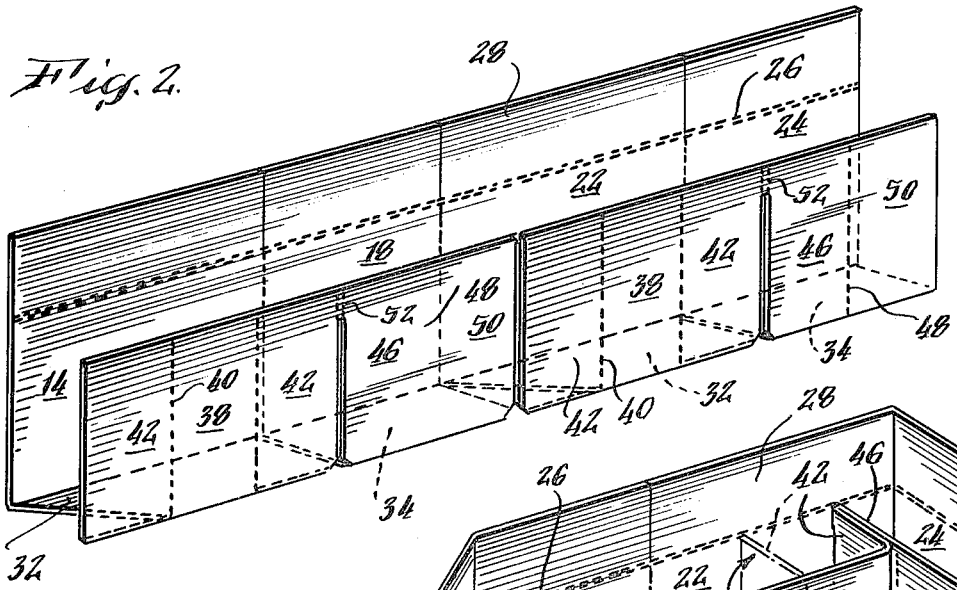

In erecting blank 12 into box 10, the bottom flaps 32 and 34 are folded ninety degrees about horizontal fold lines 30 relative to the front and rear panels 14, 22 and the side panels 18, 24 as shown in FIG. 2. The rectangular panels 38, 42, 46 and 50 are then disposed in a plane parallel to the plane of panels 14, 18, 22 and 24 by folding these panels about the horizontal fold lines 36 and 44 (FIG. 2).

Figure 3:
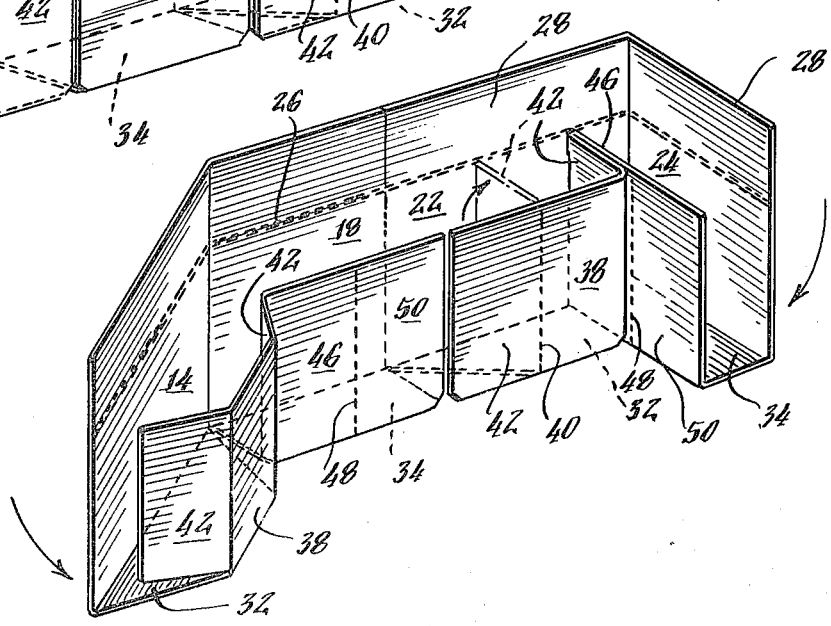

The panels 14, 18, 22 and 24 are then folded ninety degrees relative to each other about vertical fold lines 16, 20 and 25 as indicated by the arrows in FIG. 3. During this movement, the bottom panels 32 and 34 will overlap to form a closed bottom (see FIG. 6). Panels 14 and 24 can be connected by tape T or any other conventional joining means.

The central panels 38 pivotably connected by fold line 36 to the trapezoidal panels 32 are abutted in back-to-back relationship (see FIGS. 4 to 6). Each right hand panel 42 connected by double vertical fold line 52 to a panel 46 is pivoted 180 degrees relative to the panel 46 to abut the same (FIGS. 3, 5 and 8). The remaining free panels 42 are pivoted ninety degrees relative to central panel 38 to abut the rectangular panels 50 (FIG. 4), which are then pivoted ninety degrees as indicated by the arrows in FIG. 4, to form six cells 54 within the interior of box 10.

Some of the cells are bounded by double ply or abutted walls comprising panel pairs 38, 38; 42, 46; and 42, 46, enabling the box 10 to be readily stacked without collapsing. Each panel is of a size to contact an adjacent side wall to completely enclose each cell.

What is claimed as new is:

1. A paperboard box comprising:

a front wall, a rear wall, and a pair of parallel side walls connecting said front and rear walls, each of said front, rear and side walls having a bottom forming flap pivotably connected to the bottom edge thereof, each of said bottom flaps being overlapped with an adjacent one thereof, a plurality of divider walls within the interior of said box between said side walls, said divider walls including a three rectangular panel section hingedly connected along an edge of each of two of said bottom flaps, each rectangular panel in said three panel section being connected to another like panel along an edge by a fold line, a two rectangular panel section hingedly connected along an edge of each of two others of said bottom flaps, each rectangular panel in said two panel section being connected to another like panel along an edge by a fold line, and each of said panel sections being folded within the interior of said box about a hinge line connecting said section to its respective bottom flap and each panel in each panel section being folded relative to an adjacent panel to form said plurality of divider walls providing with the front, rear, and side walls thereof, six article-receiving cells.

2. The box of claim 1 wherein adjacent rectangular panels in adjacent two and three panel sections are pivotably connected.

3. The box of claim 2 wherein each of said bottom flaps connected to said three panel sections is trapezoidal in plan and each of said bottom flaps connected to said two panel section is rectangular in plan.

4. The box of claim 2 wherein each of said front, rear and side walls has a top forming flap pivotably connected to the top edge thereof.

5. The box of claim 1 wherein at least some of said divider walls are formed from abutted panel pairs.

6. The box of claim 1 wherein said two rectangular panel sections are attached to opposite bottom flaps and said three rectangular panel sections are attached to opposite bottom flaps.

7. A blank for forming a six cell box comprising:

a planar sheet divided into four rectangular panels connected together along vertical score lines, a bottom panel hingedly connected to a bottom edge of each said rectangular panels, a three panel section hingedly connected to the bottom edge of every other bottom panel, said three panel section including three rectangular panels pivotably connected along vertical fold lines, and a two panel section hingedly connected to the bottom edge of said bottom panels between every other bottom panel, said two panel sections including two rectangular panels pivotably connected along vertical score lines.

8. The blank of claim 7 wherein the middle panel of each of said three panel sections is hingedly connected to the bottom edge of every other bottom panel and the left hand most panel of each of said two panel sections is pivotably connected to the bottom edge of said bottom panels between every other bottom panel.

9. The blank of claim 8 wherein one of the panels in each of said three panel sections is connected along a vertical fold line to one of the panels in an adjacent two panel section.

10. The blank of claim 9 wherein the panels in each three panel section is of like dimension.

11. The blank of claim 10 where the panels in each two panel section is of like dimension.

12. The blank of claim 11 wherein the bottom panel connected to each three panel section is trapezoidal in plan.

13. The blank of claim 12 wherein the bottom panel connected to each two panel section is rectangular in plan.

14. The blank of claim 13 including a rectangular panel of like dimension hingedly connected to the top edge of each of said first rectangular panels.

* * * * *